United States Patent [19]

Wade, Sr. et al.

[11] Patent Number: 4,700,556

[45] Date of Patent: Oct. 20, 1987

[54] PROTECTIVE VISOR FOR DOOR HANDLES

[76] Inventors: Darrel E. Wade, Sr., P.O. Box 3266, Parkerburg, W. Va. 26101; George Spector, 233 Broadway RM 3615, New York, N.Y. 10007

[21] Appl. No.: 839,630

[22] Filed: Mar. 14, 1986

[51] Int. Cl.[4] ..... E05B 17/18

[52] U.S. Cl. ..... 70/455; 70/56; 70/416; 70/423

[58] Field of Search ..... 70/55, 56, 455, 416, 70/417, 420, 423, DIG. 56, DIG. 58

[56] References Cited

U.S. PATENT DOCUMENTS

| | | | |
|---|---|---|---|
| 416,433 | 12/1889 | Wilson | 70/56 |
| 1,055,865 | 3/1913 | Boll | 70/56 |
| 1,136,582 | 4/1915 | Birdsong | 70/56 |
| 1,220,941 | 3/1917 | Bowers | 70/56 |
| 1,614,656 | 1/1927 | Corell | 292/DIG. 2 |
| 2,075,495 | 3/1937 | Aten | 70/DIG. 58 |
| 2,461,676 | 2/1949 | Budak | 70/416 |
| 2,562,038 | 7/1951 | Jacobi | 70/455 |
| 2,564,012 | 8/1951 | Jordan | 70/455 |
| 2,585,331 | 2/1952 | King | 70/455 |
| 2,598,375 | 5/1952 | Heinz | 70/455 |
| 3,718,014 | 2/1973 | Delgadillo | 70/56 |
| 3,782,149 | 1/1974 | Carter | 292/DIG. 2 |
| 3,837,191 | 9/1974 | Soiderer | 70/DIG. 58 |
| 3,990,182 | 11/1976 | Linder | 70/56 |
| 4,106,315 | 8/1978 | Dohanyos | 70/56 |
| 4,127,967 | 12/1978 | Franzl | 70/416 |

FOREIGN PATENT DOCUMENTS

| | | | |
|---|---|---|---|
| 3202333 | 8/1983 | Fed. Rep. of Germany | 70/455 |

*Primary Examiner*—Robert L. Wolfe
*Assistant Examiner*—Suzanne L. Dino

[57] ABSTRACT

A protective visor for an automobile door handle in an outer door panel is provided and consists of a hood member secured to the outer door panel over the door handle so that the hood member will act to shed rain, hail and snow and consequently protect the door handle from all inclement weather and still allow access to operate the door handle. In a modified form the hood member is adjustably extendable to house various sizes of the door handle and includes a hinged flap portion that can flip up for access to operate a keylock.

2 Claims, 5 Drawing Figures

PROTECTIVE VISOR FOR DOOR HANDLES

BACKGROUND OF THE INVENTION

The instant invention relates generally to shield devices and more specifically it relates to a protective visor for an automobile door handle.

Numerous shield devices have been provided in prior art that are adapted to protect various mechanisms. For example, U.S. Pat. Nos. 1,136,582; 2,756,991 and 2,828,157 all are illustrative of such prior art. While these units may be suitable for the particular purpose to which they address, they would not be as suitable for the purposes of the present invention as heretofore described.

SUMMARY OF THE INVENTION

A principle object of the present invention is to provide a protective visor for an automobile door handle that will overcome the shortcomings of the prior art devices.

Another object is to provide a protective visor for an automobile door handle that will keep snow and freezing rain off the door handle so that the door handle will continue to operate.

An additional object is to provide a protective visor for an automobile door handle that is adjustable to fit any size door handle and is also designed to protect the keylock from snow and freezing rain.

A further object is to provide a protective visor for an automobile door handle that is simple and easy to use.

A still further object is to provide a protective visor for an automobile door handle that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
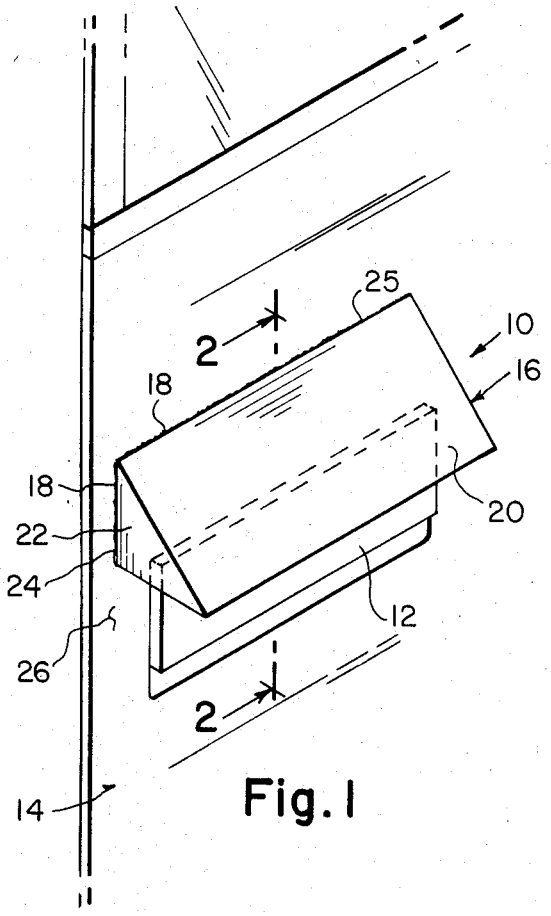
FIG. 1 is a perspective view of the invention mounted over an automobile door handle.
Figure 2:
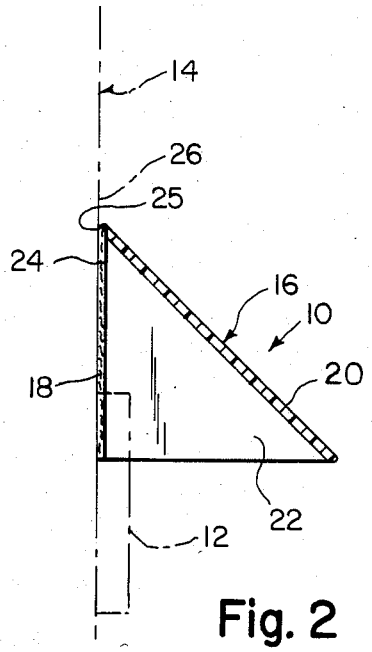
FIG. 2 is a cross sectional view taken along line 2—2 in FIG. 1.

Turning now descriptively to the drawings, in which similar reference characters denote similar elements throughout the several views, FIGS. 1 and 2 illustrate a protective visor 10 for an automobile door handle 12 in an outer door panel 14.

The visor 10 basically consists of a hood member 16 adapted to house the door handle 12 and adhesive material 18 for securing the hood member 16 to the outer door panel 14 over the door handle 12. The hood member 16 will act to shed rain, hail and snow and consequently protect the door handle 12 from all inclement weather and still allow access to operate the door handle 12.

The hood member 16 includes a body element 20 and a pair of side walls 22 formed integrally therewith. The side walls are formed in the nature of a right angle triangle with one leg 24 and top edge 25 of the body element 20 having the adhesive material 18 bear against adjacent face 26 of the outer door panel 14 and the body element 20 downwardly inclined.

Figure 3:
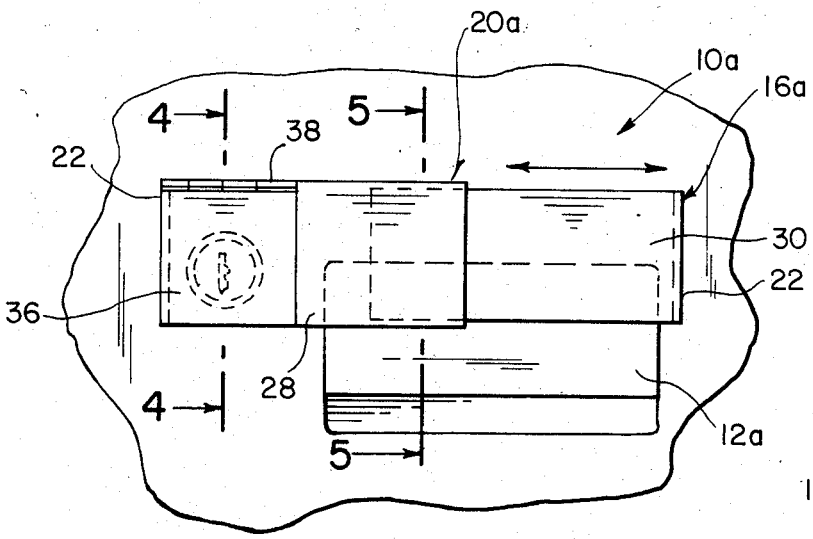
FIG. 3 is a front view of a modification mounted over a keylock and door handle of an automobile in which a portion of the visor flips up to gain access to the keylock and the other portion of the visor is adjustable to fit any type of door handle.
Figure 4:
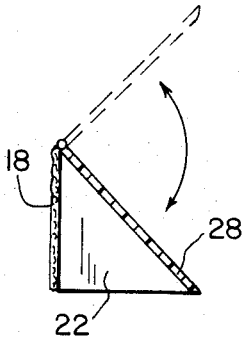
FIG. 4 is a cross sectional view taken along line 4—4 in FIG. 3 through the flip up portion of the visor.

FIG. 3 shows a modified protective visor **10*a* wherein the body element 20*a* of the hood member 16*a* is adjustably extendable and adapted to house various sizes of the door handle 12*a***.

Figure 5:
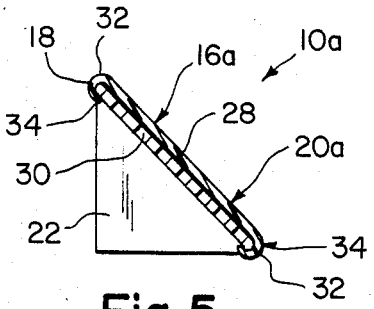
FIG. 5 is a cross sectional view taken along line 5—5 in FIG. 3 through the adjustable portion of the visor.

The adjustably extendable body element **20*a* includes two plates 28 and 30. As best seen in FIG. 5 the first plate 28 has upper and lower edges 32 turned to produce tracks 34 so that the second plate 30 can slide within the tracks 34**.

The adjustably extendable body element **20*a* further includes a flap portion 36 hinged at 38 between the first plate 28 and one of the side walls 22. The flap portion 36 can flip up for access to operate a keylock in the outer door panel adjacent the door handle 12*a***.

The protective visor 10 and **10*a* can be made out of metal or plastic and can come in a matching color to the automobile. An emblem (not shown) of the automobile can be attached to the body elements 20 and 20*a* to enhance the look of the visors on the outer door panels 14 and 14*a***.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A protective visor for an automobile door handle in an outer door panel, said visor comprising:

(a) a hood member adapted to house said door handle; and (b) means for securing said hood member to said outer door panel over said door handle so that said hood member will act to shed rain, hail snow and consequently protect said door handle from all inclement weather and still allow access to operate said door handle, wherein said hood member includes a body element and a pair of side walls formed integrally therewith, said side walls are formed in the nature of a right angle triangle with one leg and top edge of said body element having adhesive securing bear against the adjacent face of said outer door panel and said body element downwardly inclined, wherein said body element of said hood member is adjustably extendable and adapted to house various sizes of said door handle, wherein said adjustably extendable body element includes two plates, said first plate having upper and lower edges turned to produce tracks so that said second plate can slide within said track, wherein said adjustably extendable element further includes a flap hinged thereon and adapted to extend to a position overlying a keylock whereby the flap can be pivoted away from said extendable element to provide access to said keylock.

2. A visor as in claim 1, wherein said flap is hinged between said first plate and a side wall.

* * * * *